US011559993B2

(12) United States Patent
Porter

(10) Patent No.: US 11,559,993 B2
(45) Date of Patent: Jan. 24, 2023

(54) MULTI-COLOR MULTI-SPEED PRINTING APPARATUS WITH CIRCULATION

(71) Applicant: ELECTRONICS FOR IMAGING, INC., Fremont, CA (US)

(72) Inventor: Christopher Andrew Porter, Weare, NH (US)

(73) Assignee: Electronics for Imaging, Inc., Fremont, CA (US)

( * ) Notice: Subject to any disclaimer, the term of this patent is extended or adjusted under 35 U.S.C. 154(b) by 0 days.

(21) Appl. No.: 17/843,788

(22) Filed: Jun. 17, 2022

(65) Prior Publication Data

US 2022/0314635 A1 Oct. 6, 2022

Related U.S. Application Data

(60) Continuation of application No. 17/164,326, filed on Feb. 1, 2021, now Pat. No. 11,400,727, which is a division of application No. 16/460,426, filed on Jul. 2, 2019, now Pat. No. 10,913,258.

(51) Int. Cl.
*B41J 2/175* (2006.01)

(52) U.S. Cl.
CPC ..... *B41J 2/17596* (2013.01); *B41J 2/17566* (2013.01)

(58) Field of Classification Search
CPC ..... B41J 2/17596; B41J 2/17566; B41J 2/18; B41J 2/175
See application file for complete search history.

(56) References Cited

U.S. PATENT DOCUMENTS

| | | | | |
|---|---|---|---|---|
| 6,079,808 | A | 6/2000 | Yamaguchi | |
| 6,206,511 | B1 | 3/2001 | Cook et al. | |
| 6,786,578 | B1 | 9/2004 | Aschman et al. | |
| 10,913,285 | B2 | 2/2021 | Porter | |
| 2004/0263585 | A1 | 12/2004 | Jeanmaire | |
| 2005/0052513 | A1 | 3/2005 | Inoue | |
| 2010/0157002 | A1 | 6/2010 | Takada et al. | |
| 2010/0177148 | A1* | 7/2010 | Asami | B41J 2/175 347/85 |
| 2013/0235114 | A1 | 9/2013 | Van Thillo et al. | |
| 2013/0271539 | A1* | 10/2013 | Ando | B41J 2/175 347/90 |
| 2015/0085032 | A1 | 3/2015 | Ando et al. | |
| 2016/0325555 | A1 | 11/2016 | Franck | |
| 2016/0347074 | A1 | 12/2016 | Ribeiro et al. | |
| 2019/0217623 | A1 | 7/2019 | Nagatsuka | |
| 2021/0155008 | A1 | 5/2021 | Porter | |

* cited by examiner

*Primary Examiner* — Jannelle M Lebron
(74) *Attorney, Agent, or Firm* — Perkins Coie LLP

(57) ABSTRACT

Methods, systems, and devices related to a printer system that includes a first primary ink tank holding a dark-colored ink, a second primary ink tank holding a light-colored ink, a first selector valve configured to change a state, a first secondary ink tank connected to the first primary ink tank via the first selector valve, a second secondary ink tank connected to the first and second primary ink tanks via the first selector valve, a second selector valve connected to the first primary ink tank configured to return the dark-colored ink from the print heads to the first primary ink tank, and a third selector valve connected to the second selector valve and the second primary ink tank configured to either return the light-colored ink from the print heads to the second primary ink tank or to direct the dark-colored ink to the second selector valve.

15 Claims, 8 Drawing Sheets

MULTI-COLOR MULTI-SPEED PRINTING APPARATUS WITH CIRCULATION

CROSS-REFERENCE TO RELATED APPLICATION

This application is a continuation of U.S. patent application Ser. No. 17/164,326 filed on Feb. 1, 2021, which is a divisional of U.S. patent application Ser. No. 16/460,426 filed on Jul. 2, 2019, issued as U.S. Pat. No. 10,913,285, which are incorporated herein by reference in their entirety.

TECHNICAL FIELD

This patent document relates to printer systems and, in particular, to recirculation designs for printer systems that support multi-color multi-speed modes.

BACKGROUND

Ink jet printer systems typically use a columnar array of print elements or nozzles to be swept horizontally across a printed medium while the nozzles selectively print points that represent printed pixels. To achieve optimal quality and speed, some printer systems includes multiple ink reservoirs to allow switching between color modes to achieve different printing speeds. However, switching between different ink reservoirs can introduce air into the ink lines and reservoirs, thereby impacting printing quality. There exists a need to reduce the impact of air to printer systems while achieving a balance between printing speed and quality.

SUMMARY

This document discloses embodiments related to methods, devices, and systems that use multiple selector valves to ensure that inks of different colors are returned to the proper reservoirs during recirculation. The disclosed techniques can ensure that primary ink reservoirs are not contaminated during print mode switches. Furthermore, the disclosed techniques allow fresh, degassed ink to be provided to the print heads after recirculation.

One example aspect of the disclosed embodiments relates to a printer system that includes, for each of one or more ink color groups, a first primary ink tank holding a dark-colored ink, a second primary ink tank holding a light-colored ink, a first selector valve configured to change a state according to a print mode of the system, a first secondary ink tank connected to the first primary ink tank via the first selector valve, a second secondary ink tank connected to the first and second primary ink tanks via the first selector valve, a second selector valve connected to the first primary ink tank configured to return the dark-colored ink from the first or the second set of print heads to the first primary ink tank, and a third selector valve connected to the second selector valve and the second primary ink tank configured to either return the light-colored ink from the second set of print heads to the second primary ink tank or to direct the dark-colored ink to the second selector valve. The first secondary ink tank is configured to store the dark-colored ink and to provide the dark-colored ink to a first set of print heads. The second secondary ink tank is configured to store either the dark-colored ink or the light-colored ink and to provide the dark-colored ink or the light-colored ink to a second set of print heads according to the state of the first selector valve.

Another example aspect of the disclosed embodiments relates to a method for switching a printing color of a printer system. The printer system comprises a first primary ink tank holding a dark-colored ink, a second primary ink tank holding a light-colored ink, a secondary ink tank, and a selector valve. The method includes drawing an existing ink from the secondary ink tank to either the first primary ink tank or the secondary primary ink tank based on a color of the existing ink, purging the existing ink from the secondary ink tank, operating the selector valve to fill the secondary ink tank with a different ink, flushing the secondary ink tank and corresponding ink lines using the different ink, and circulating the secondary ink tank and the corresponding ink lines to remove remaining air. The different ink is drawn from either the second primary ink tank or the first primary ink tank according to the color of the existing ink.

The details of one or more implementations are set forth in the accompanying attachments, the drawings, and the description below. Other features will be apparent from the description and drawings, and from the claims.

DETAILED DESCRIPTION

Ink jet printer systems are adapted for printing images using a carriage that holds a set of print heads across a printed medium while the print heads deposit ink as the medium moves. Such printer systems typically use different colored inks to achieve the desired images. In general, a greater number of colored inks leads to a higher-quality final image than those generated with fewer colored inks. In many applications, printer systems that support multiple modes, for example, one mode using a higher number of colored inks and one mode using a lower number of colored inks, can be used to adaptively achieve quality and speed according to the image.

In general, the printer system 100 prints images using various color groups, including black, yellow, cyan, magenta, and white. Dark-colored inks thus include at least black (BLK), yellow (Y), cyan (C), and magenta (M). To achieve a better printing quality, the printer system 100 also uses corresponding light-colored inks for each group, such as light black (LBLK), light yellow (LY), light cyan (LC), and light magenta (LM). In some implementations, the printer system 100 also uses the same color for the white color group. That is, there is no different between the dark-colored white and the light-colored white.

Figure 1:
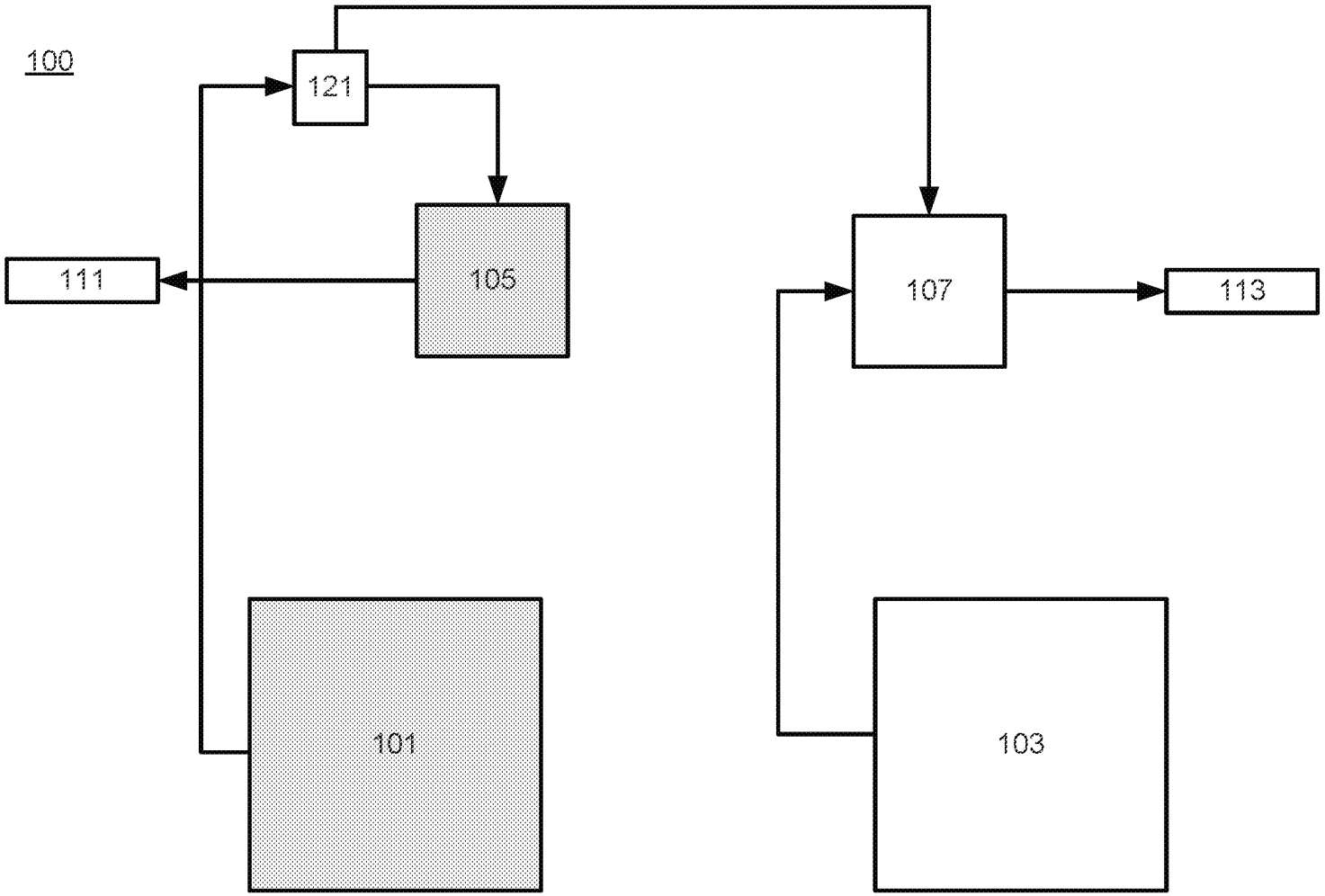
FIG. 1 illustrates an example schematic diagram of a printer system that supports multiple printing modes to achieve an optimal combination of quality and speed.

FIG. 1 illustrates an example schematic diagram of a printer system 100 that supports multiple printing modes to achieve an optimal combination of quality and speed. In FIG. 1, there are two example primary ink reservoirs, also referred to as ink tanks, of the printer system 100: the dark primary tank 101 and the light primary tank 103. A set of secondary tanks are provided by the printer system 100. A dark secondary tank 105 is connected to the dark primary tank 101. A light/dark secondary tank 107 is connected to either the dark primary tank 101 or the light primary tank 103 via a selector valve 121. The printer system 100 also includes a first set of print heads 111 and a second set of print heads 113. The first set of print heads 111 takes ink from the dark secondary tank 105 and thus deposits dark colors (e.g., BLK, Y, C, or M) onto the printed medium. The second set of print heads 113 takes ink from the light/dark secondary tank 107 and thus is capable of depositing either light colors or dark colors onto the printed medium.

The selector valve 121 allows the printer system 100 to operate in at least two modes. For example, in the quality mode, the first set of print heads 111 receives dark-colored inks from the dark secondary tank 105 and the second set of print heads 113 receives light-colored inks from the light/dark secondary tank 107, thereby printing images using eight colors. To switch to the fast mode, the selector valve 121 allows the light/dark secondary tank 107 to draw ink from the dark primary tank 101. Both the first and second set of print heads 111, 113 can receive dark-colored inks, thereby printing images using four colors only.

However, switching between the dark and light primary tanks can introduce additional air into the print heads, the ink lines, and the secondary tanks, which impacts the printing quality of the printer systems. To improve printing quality, reliability, and performance, printers are increasingly being designed to recirculate ink between the main ink supply and the inkjet print heads. The recirculation printer systems circulate ink through the print heads and return it to the ink tanks to carry away and filter out any particles or air introduced by the print nozzles. The recirculation can also keep ink temperature and viscosity uniform. Recirculation designs must ensure that inks are returned to the proper primary tanks without possibly contaminating the entire tank. When switching between the light and dark inks, however, the secondary tanks and corresponding ink lines may potentially contain a mixture of light and dark colors, posing a challenge for recirculation designs in multi-color printer systems. Disclosed herein are techniques that can be implemented in various embodiments to ensure that recirculation can be properly provided for printer systems that support multiple color modes for faster printing.

Figure 2:
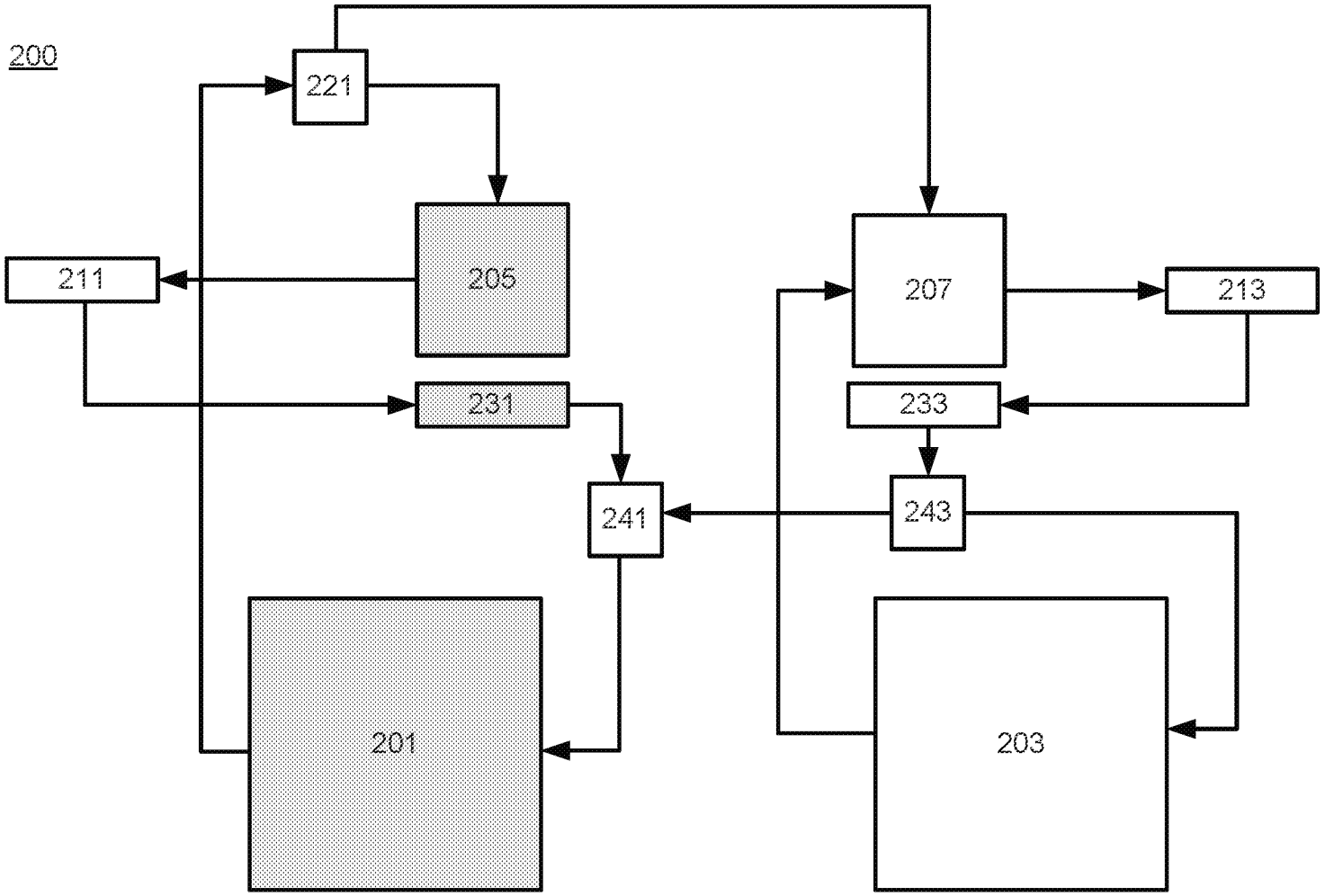
FIG. 2 illustrates an example schematic diagram of a recirculation printer system that supports multiple printing modes in accordance with the present technology.

FIG. 2 illustrates an example schematic diagram of a recirculation printer system 200 that supports multiple printing modes in accordance with the present technology. The printer system 200 uses at least one dark primary tank 201 and one light primary tank 203. A dark secondary tank 205 is connected to the dark primary tank 201. A light/dark secondary tank 207 is connected to either the dark primary tank 201 or the light primary tank 203 via a selector valve 221. The printer system 200 also includes a first set of print heads 211 and a second set of print heads 213. The first set of print heads 211 takes ink from the dark secondary tank 205 and thus deposits dark colors (e.g., BLK, Y, C, or M) onto the printed medium. The second set of print heads 213 takes ink from the light/dark secondary tank 207 and thus deposits either light colors or dark colors onto the printed medium. The printer system 200 optionally includes a first tertiary tank 231 and a second tertiary tank 233 to draw fluids from a plurality of print heads at the same time.

To enable recirculation of the inks, the printer system 200 includes multiple selector valves 241, 243 and ink lines to allow the ink from the secondary or tertiary tanks to return to the primary tanks. In some embodiments, the selector valve is a three-way solenoid valve to manage the selection of correct primary tanks to return the ink to. For example, as shown in FIG. 2, the selector valve 241 is a three-way solenoid valve to select either the first tertiary tank 231 or the second tertiary tank 233 (via the selector valve 243) so that dark ink can be returned to the dark primary tank 201. The selector valve 243 is also a three-way solenoid valve to either return the light ink from the second tertiary tank 233 to the light primary tank 203, or to direct the dark ink from the second tertiary tank 233 to the other selector valve 241.

Figure 3:
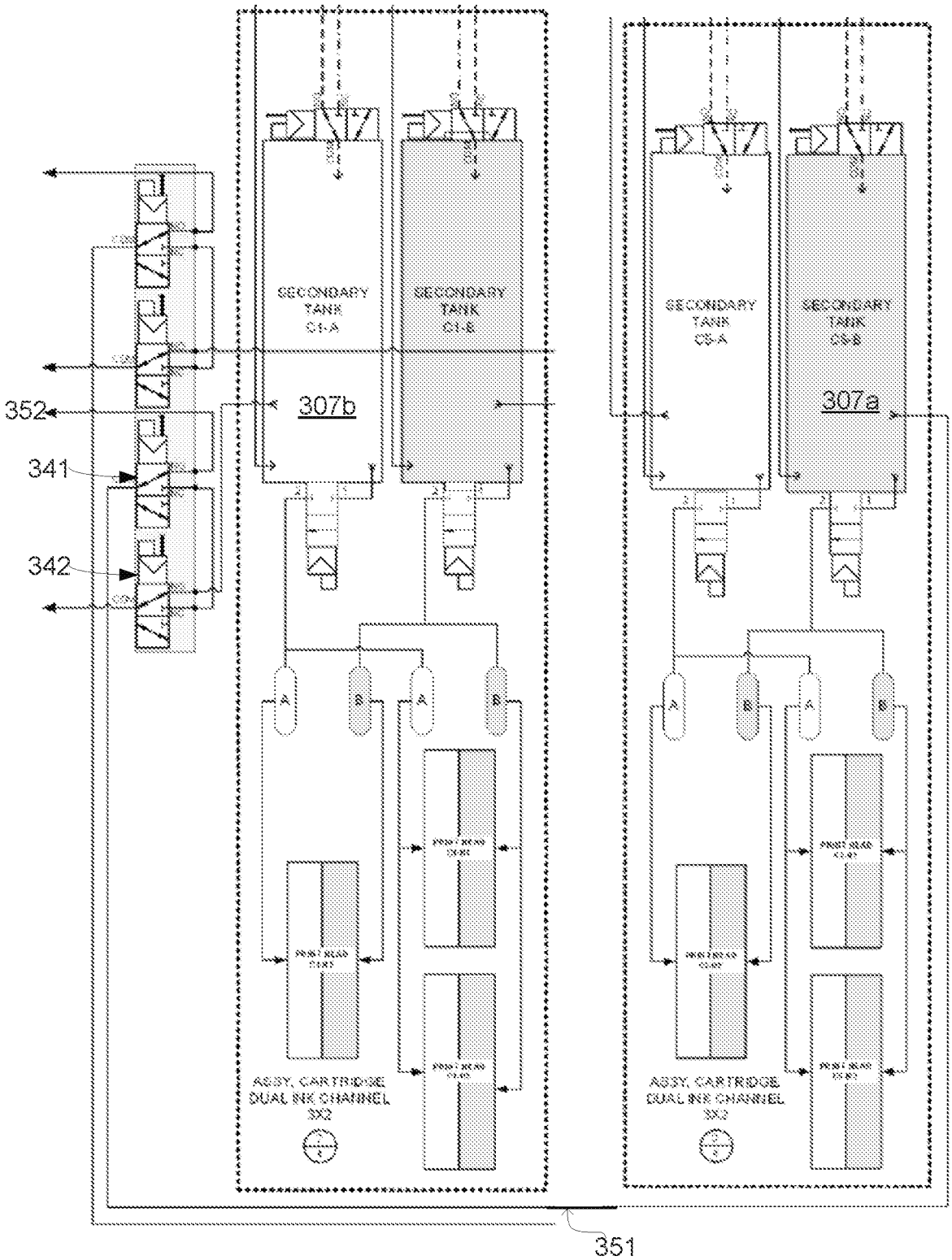
FIG. 3 illustrates a schematic diagram of a pair of secondary tanks and corresponding selector valves in accordance with the technology.

In some embodiments, a light secondary tank and a dark secondary tank can be organized in a pair so that a selector valve can control both for properly switching the colors. FIG. 3 illustrates a schematic diagram of a pair of secondary tanks and corresponding selector valves in accordance with the technology. In FIG. 3, a dark secondary tank 307*a* is connected to a first valve 341 via ink line 351. In a normal open (NO) state of the first valve 341, the dark ink is fed back to the corresponding primary tank via ink line 352. When the first valve 341 is energized, the first valve 341 turns into a normal closed (NC) state such that the first valve 341 is connected to a second valve 342. The second valve 342 is also connected to a light secondary tank 307*b* that forms a pair with the dark secondary tank 307*a*. Thus, the second valve 342 controls a pair of light/dark secondary tanks 307*a*, 307*b* and can switch between them to draw ink to the correct primary tank to enable faster printing when necessary.

In some embodiments, the printer system determines when to perform color switch based on how much ink is left in the secondary tanks. For example, the secondary tanks can include a flow indicator that indicates the position of the ink, such as "Low" or "Full." When the flow indicator indicates that the ink is low, the valve that controls the secondary tank can be operated to fill the secondary tank. At the same time, the valve draws ink from the other secondary tank in the pair as a part of the recirculation process.

Figure 8:
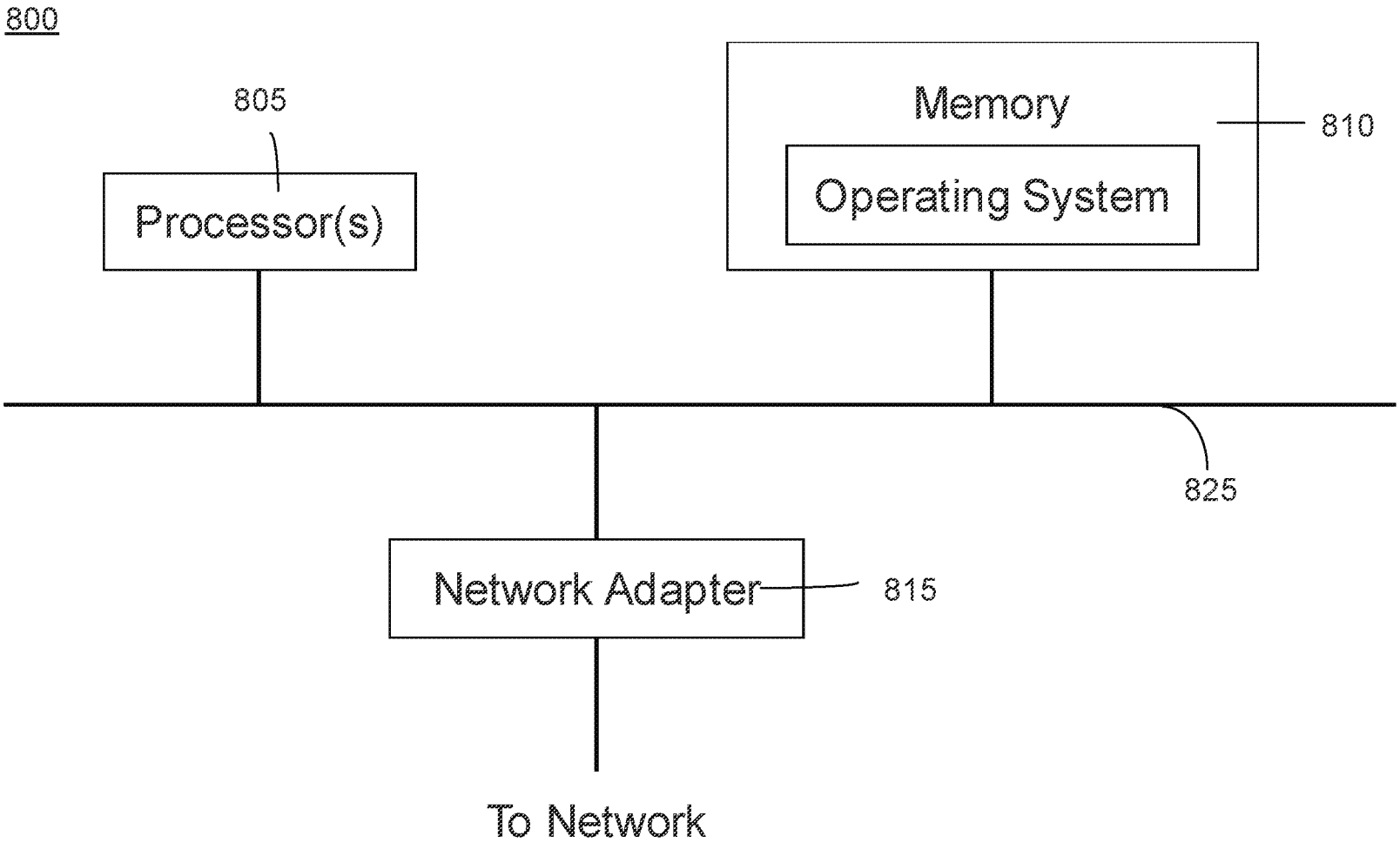
FIG. 8 is a block diagram illustrating an example of the architecture for a computer system or a control device of a printer system that can be utilized to implement various portions of the presently disclosed technology.

In some embodiments, a primary tank may contain a large amount of ink, for example, 20 liters of ink. Contaminating the primary tanks causes a significant waste of the inks. Thus, the recirculation state must be set correctly so that inks from the secondary tanks are not sent to the wrong primary tank. In some embodiments, the printer system includes a computer system or a control device to ensure that there is no contamination when switching colors. FIG. 8 is a block diagram illustrating an example of the architecture for a computer system or a control device 800 of the printer system that can be utilized to implement various portions (e.g., controlling the array of nozzles) of the presently disclosed technology. In FIG. 8, the control device 800 includes one or more processors 805 and memory 810 connected via an interconnect 825. The interconnect 825 may represent any one or more separate physical buses, point to point connections, or both, connected by appropriate bridges, adapters, or controllers. The interconnect 825, therefore, may include, for example, a system bus, a Peripheral Component Interconnect (PCI) bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 674 bus, sometimes referred to as "Firewire." The processor(s) 805 may include central processing units (CPUs), graphics processing units (GPUs), or other types of processing units (such as tensor processing units) to control the overall operation of, for example, the host computer. In certain embodiments, the processor(s) 805 accomplish this by executing software or firmware stored in memory 810. The processor(s) 805 may be, or may include, one or more programmable general-purpose or special-purpose microprocessors, digital signal processors (DSPs), programmable controllers, application specific integrated circuits (ASICs), programmable logic devices (PLDs), or the like, or a combination of such devices. The memory 810 can be or include the main memory of the computer system. The memory 810 represents any suitable form of random access memory (RAM), read-only memory (ROM), flash memory, or the like, or a combination of such devices. In use, the memory 810 may contain, among other things, a set of machine instructions which, when executed by processor 805, causes the processor 805 to perform operations to implement embodiments of the presently disclosed technology. Also connected to the processor(s) 805 through the interconnect 825 is a (optional) network adapter 815. The network adapter 815 provides the computer system 800 with the ability to communicate with remote devices, such as the storage clients, and/or other storage servers, and may be, for example, an Ethernet adapter or Fiber Channel adapter.

Figure 4:
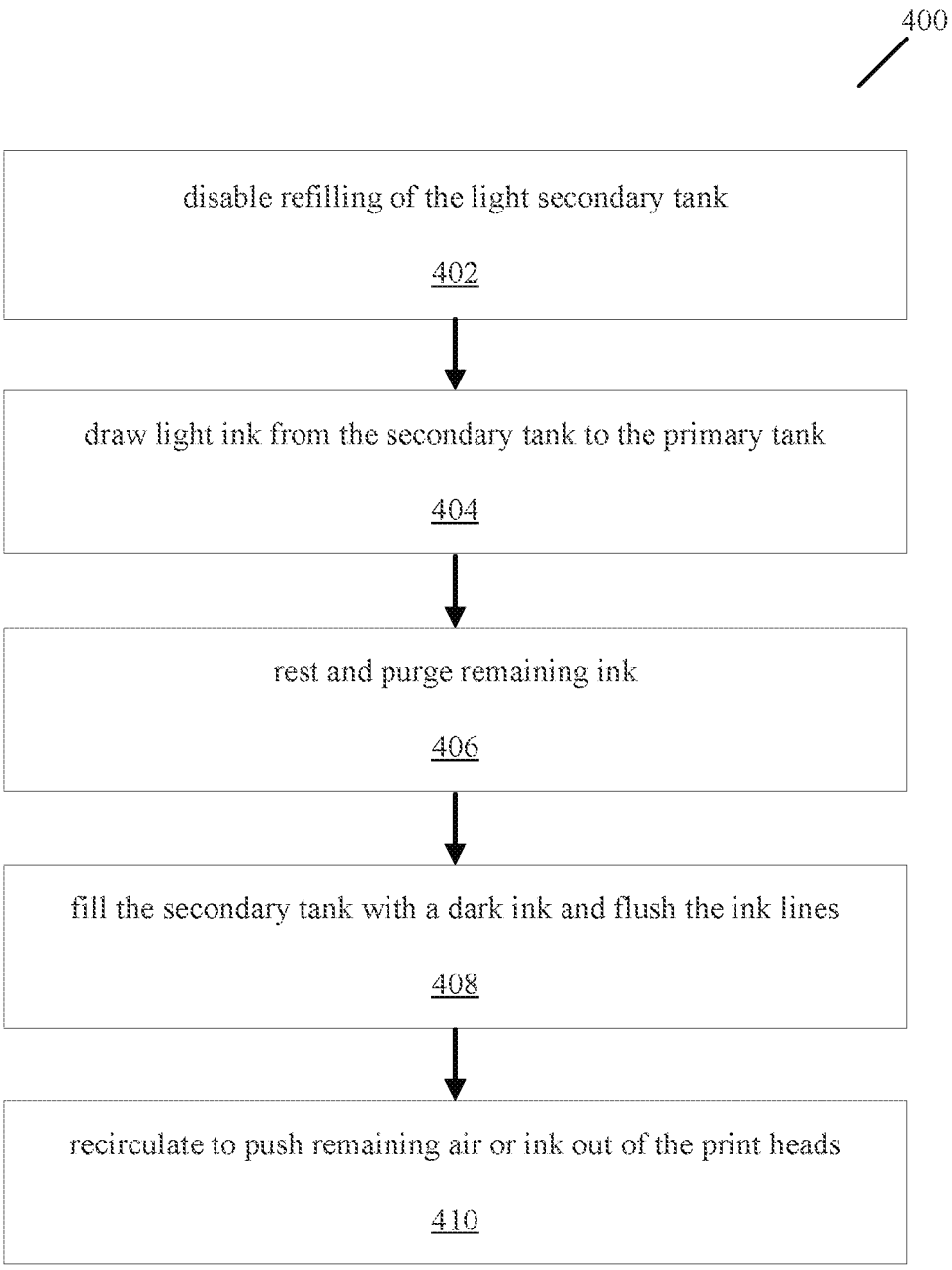
FIG. 4 is a flowchart representation of a changeover process that can be performed by a control device to switch from a light color to a dark color in accordance with the present technology.

FIG. 4 is a flowchart representation of a changeover process 400 that can be performed by a control device to switch from a light color to a dark color in accordance with the present technology.

Operation 402: The printer system disables refilling of the light secondary ink tank.

Operation 404: The printer system draws light ink from the secondary ink tank back to the primary ink tank until the flow indicator indicates that the tank is empty. In some embodiments, the secondary ink tank is then purged to make sure the ink lines are empty as well. The purge operation is to ensure that there is no contamination in the ink lines after the recirculation. In some implementations, the purge operation can last around 20 to 30 seconds. If the printer system includes one or more tertiary tanks, the tertiary tanks are also purged. After the purge, ink bubbles may only present on the face of each print head in the color channel.

Operation 406: The printer system is placed in a rest mode to allow ink to settle to low points of the secondary ink tank assembly. In some implementations, the printer system can rest between 1 to 3 minutes to allow the ink to settle. The assembly, including the ink lines and the tanks, can also be purged again after resting.

Operation 408: After the purge operation is completed, the printer system energizes the selector valves to fill the emptied secondary ink tank with dark ink until ink level indicates "Full" position. The system then flushes the ink lines to make sure that any remaining light ink is pushed out.

Operation 410: The printer system runs recirculation for a period of time (e.g., 5-15 minutes) to remove any remaining light ink or air, and to push the dark ink to the print heads. The system can also perform additional purge operations, if necessary.

Figure 5:
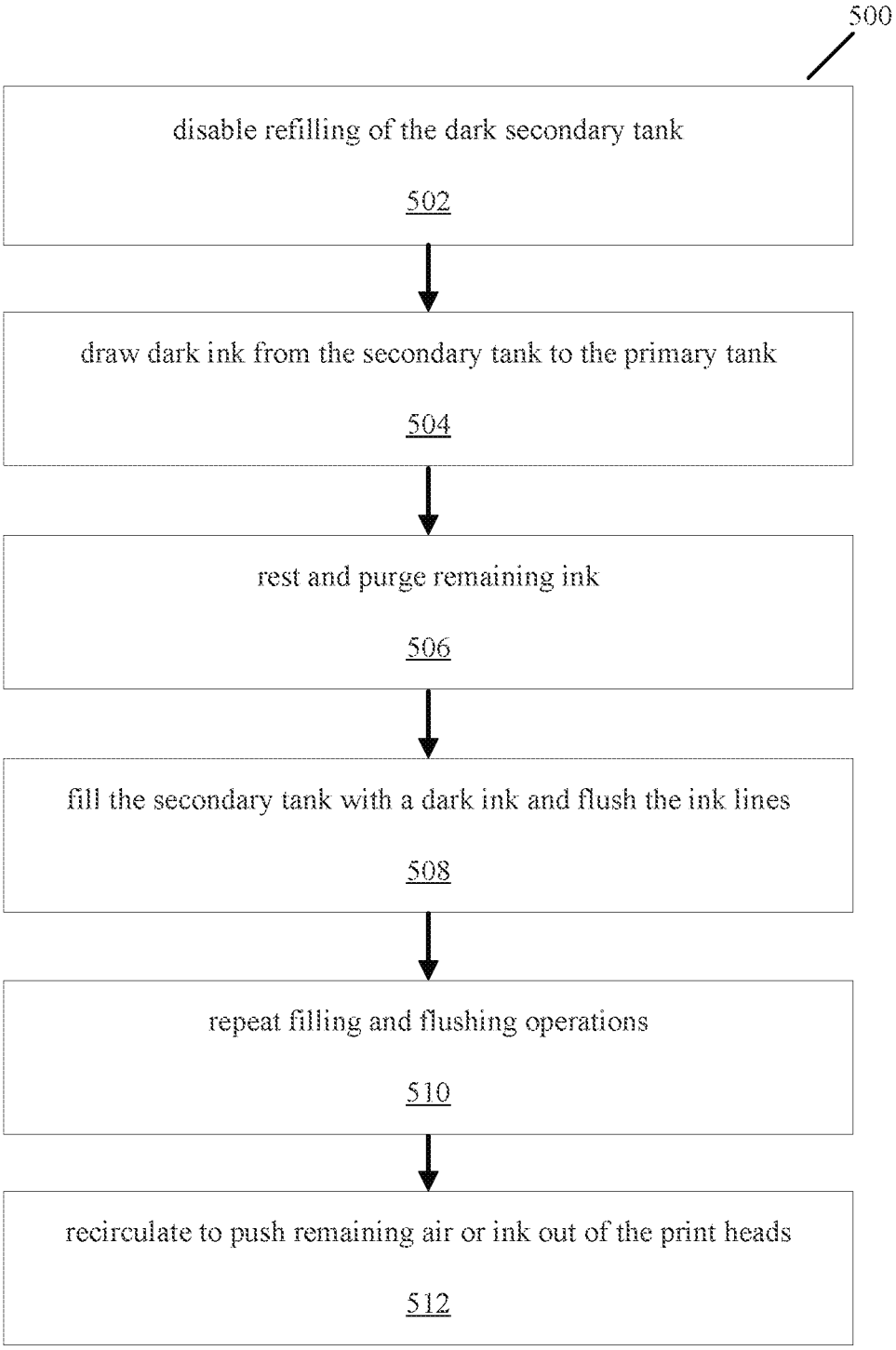
FIG. 5 is a flowchart representation of a changeover process 500 that can be performed by a control device to switch from a dark color to a light color in accordance with the present technology.

FIG. 5 is a flowchart representation of a changeover process 500 that can be performed by the control device to switch from a dark color to a light color in accordance with the present technology.

Operation 502: The printer system disables refilling of the light secondary ink tank.

Operation 504: The printer system draws the dark ink from the secondary ink tank back to the primary ink tank until the flow indicator indicates that the tank is empty. In some embodiments, the secondary ink tank is then purged to make sure the ink lines are empty as well. Because there is a higher risk of contamination when switching from a dark color to a light color, additional purge time can be added to make sure that the ink assembly is clear. For example, the purge operation here can last about 60 seconds. If the printer system includes one or more tertiary tanks, the tertiary tanks are also purged. After the purge, ink bubbles may only present on the face of each print head in the color channel.

Operation 506: The printer system is placed in a rest mode to allow ink to settle to low points of the secondary ink tank assembly. In some implementations, the printer system can rest for 2 minutes to allow the ink to settle. The assembly, including the ink lines and the tanks, can then be purged again.

Operation 508: After the purge operation is completed, the printer system de-energizes the selector valves to fill the emptied secondary ink tank with light ink until ink level indicates "Full" position. The system then flushes the ink lines to make sure that any remaining dark ink is pushed out.

Operation 510: Because there is a higher risk of contamination when switching from a dark color to a light color, the filling and flushing in Operation 508 are repeated again.

Operation 512: The printer system runs recirculation for a period of time (e.g., 10 minutes) to remove any remaining light ink or air, and to push the light ink to the print heads. The system can also perform additional purge operations, if necessary.

The changeover processes depicted in FIG. 4 and FIG. 5 can be performed according to the desired printing quality and speed for the image.

Figure 6:
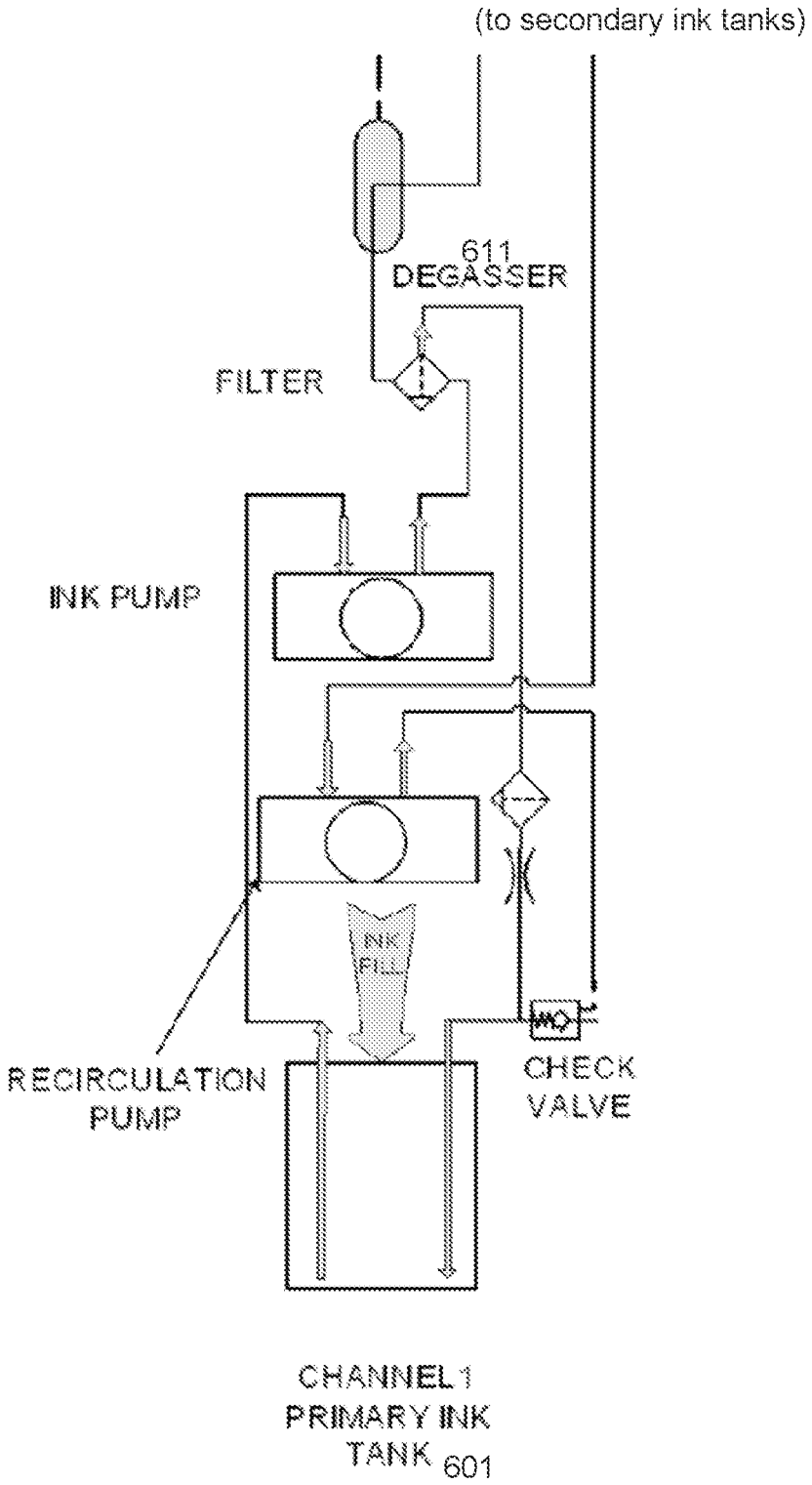
FIG. 6 is an example schematic diagram of a recirculation configuration in accordance with the present technology.

FIG. 6 is an example schematic diagram of a recirculation configuration in accordance with the present technology. As shown in FIG. 6, a degasser 611 is placed on an ink line between the primary ink tank 601 and a corresponding secondary tank (not shown). The placement of the degasser allows the recirculation process to provide freshly degassed paint to secondary tanks, thereby further enhancing the printing quality of the printer system.

Figure 7:
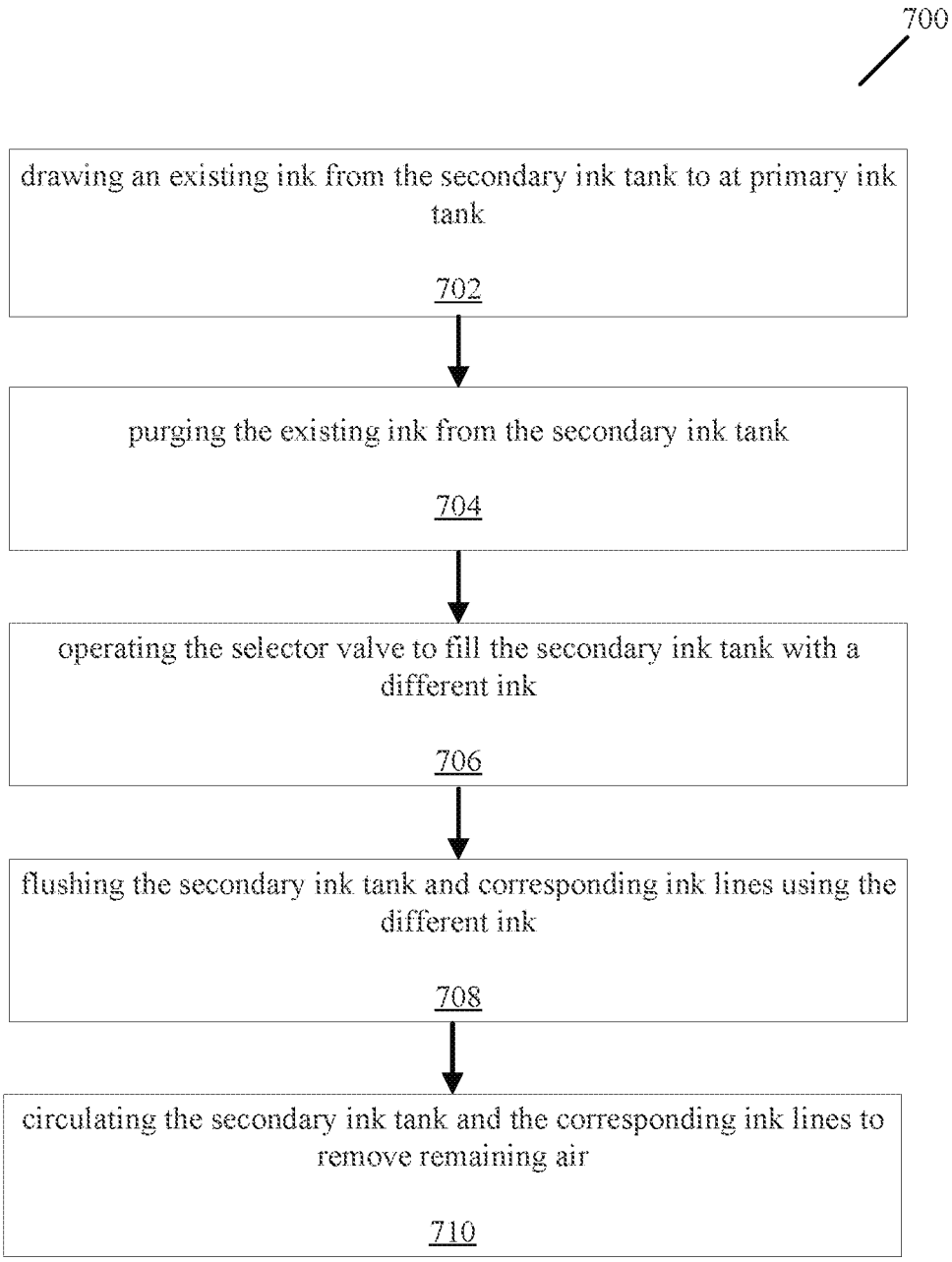
FIG. 7 is a flowchart representation of a method for switching a printing color of a printer system.

FIG. 7 is a flowchart representation of a method 700 for switching a printing color of a printer system. The printer system comprises a first primary ink tank holding a dark-colored ink, a second primary ink tank holding a light-colored ink, a secondary ink tank, and a selector valve. The method 700 includes, at operation 702, drawing an existing ink from the secondary ink tank to either the first primary ink tank or the secondary primary ink tank based on a color of the existing ink. The method 700 includes, at operation 704, purging the existing ink from the secondary ink tank. The method 700 includes, at operation 706, operating the selector valve to fill the secondary ink tank with a different ink. The different ink is drawn from either the second primary ink tank or the first primary ink tank according to the color of the existing ink. The method 700 includes, at operation 708, flushing the secondary ink tank and corresponding ink lines using the different ink. The method 700 includes, at operation 710, circulating the secondary ink tank and the corresponding ink lines to remove remaining air.

In some embodiments, the method includes disabling refilling of the secondary ink tank prior to drawing the existing ink. In some embodiments, drawing the existing ink includes determining an ink level of the secondary ink tank based on an indicator, and drawing the existing ink in case the ink level indicates that the secondary ink tank is empty. In some embodiments, the existing ink is a light-colored ink, and purging the existing ink can last between 20 to 30 seconds.

In some embodiments, the printer system further comprises a tertiary tank for drawing ink from a set of print heads, and the method further comprises purging the existing ink from the tertiary ink tank. In some embodiments, the method includes placing the printer system in a rest mode to allow the existing ink to settle to a low point of the secondary ink tank. In some embodiments, the printer system is placed in the rest mode for 1 to 3 minutes.

In some embodiments, the existing ink is a dark-colored ink and the different ink is a light-colored ink, and the method further comprises operating the selector valve to fill the secondary ink tank again; and flushing the secondary ink tank and corresponding ink lines using the light-colored ink again. In some embodiments, the secondary ink tank and the corresponding ink lines are circulated for 5 to 15 minutes.

From the foregoing, it will be appreciated that specific embodiments of the presently disclosed technology have been described herein for purposes of illustration, but that various modifications may be made without deviating from the scope of the invention. Accordingly, the presently disclosed technology is not limited, except as by the appended claims.

The disclosed and other embodiments, modules, and the functional operations described in this document, for example, the control device, can be implemented in digital electronic circuitry, or in computer software, firmware, or hardware, including the structures disclosed in this document and their structural equivalents, or in combinations of one or more of them. The disclosed technology and other embodiments can be implemented as one or more computer program products, for example, one or more modules of computer program instructions encoded on a computer readable medium for execution by, or to control the operation of, a data processing apparatus. The computer readable medium can be a machine-readable storage device, a machine-readable storage substrate, a memory device, a composition of matter effecting a machine-readable propagated signal, or a combination of one or more them. The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, for example, code that constitutes processor firmware, a protocol stack, a database management system, an operating system, or a combination of one or more of them. A propagated signal is an artificially generated signal, for example, a machine-generated electrical, optical, or electromagnetic signal, that is generated to encode information for transmission to suitable receiver apparatus.

A computer program (also known as a program, software, software application, script, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this document can be performed by one or more programmable processors executing one or more computer programs to perform functions by operating on input data and generating output. The processes and logic flows can also be performed by, and apparatus can also be implemented as, special purpose logic circuitry, for example, an field programmable gate array (FPGA) or an application specific integrated circuit (ASIC).

Processors suitable for the execution of a computer program include, by way of example, both general and special purpose microprocessors, and any one or more processors of any kind of digital computer. Generally, a processor will receive instructions and data from a read only memory or a random-access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, for example, magnetic, magneto optical disks, or optical disks. However, a computer need not have such devices. Computer readable media suitable for storing computer program instructions and data include all forms of non-volatile memory, media, and memory devices, including by way of example semiconductor memory devices, for example, EPROM, EEPROM, and flash memory devices; magnetic disks, for example, internal hard disks or removable disks; magneto optical disks; and CD ROM and DVD-ROM disks. The processor and the memory can be supplemented by, or incorporated in, special purpose logic circuitry.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described and other implementations, enhancements, and variations can be made based on what is described and illustrated in this patent document.

What is claimed is:

1. A printer system, comprising:

a first primary ink tank holding a first ink;

a second primary ink tank holding a second ink;

a first secondary ink tank connected to the first primary ink tank, the first secondary ink tank configured to store the first ink and to provide the first ink to a first set of print heads;

a second secondary ink tank connected to the first primary ink tank and the second primary ink tank, the second secondary ink tank configured to store either the first ink or a second ink and to provide the first ink or the second ink to a second set of print heads;

a first selector valve connected to the first primary ink tank configured to return the first ink from the first set of print heads or the second set of print heads to the first primary ink tank; and a second selector valve connected to the first selector valve and the second primary ink tank configured to either return the second ink from the second set of print heads to the second primary ink tank or to direct the first ink to the first selector valve.

2. The printer system of claim 1, wherein the first selector valve comprises a three-way solenoid.

3. The printer system of claim 1, wherein the second selector valve comprises a three-way solenoid.

4. The printer system of claim 1, wherein the first ink comprises a dark-colored ink.

5. The printer system of claim 1, wherein the second ink comprises a light-colored ink.

6. The printer system of claim 1, comprising a control device configured to initiate, based on a print mode of the printer system, a switching of an ink stored in the second secondary ink tank.

7. The printer system of claim 6, wherein the control device is configured to, in the changeover process:

draw an existing ink from the second secondary ink tank to a corresponding primary tank;

purge the existing ink from the second secondary ink tank;

fill the second secondary ink tank with a different ink;

flush the second secondary ink tank and corresponding ink lines using the different ink; and circulate the second secondary ink tank and the corresponding ink lines to remove remaining air.

8. The printer system of claim 7, wherein the existing ink is a dark-colored ink, and wherein the control device is further configured to fill and flush the second secondary ink tank and the corresponding ink lines again using the different ink.

9. The printer system of claim 7, wherein the control device is configured to disable refilling of the second secondary ink tank prior to drawing the existing ink.

10. The printer system of claim 7, wherein the existing ink is a light-colored ink, and wherein the control device is configured to purge the existing ink between 20 to 30 seconds.

11. The printer system of claim 7, wherein the control device is configured to place the printer system in a rest mode for 1 to 3 minutes.

12. The printer system of claim 7, wherein the second secondary ink tank and the corresponding ink lines are circulated for 5 to 15 minutes.

13. The printer system of claim 1, further comprising:

a first tertiary ink tank connected to the first set of print heads to draw the first ink from the first set of print heads; and a second tertiary ink tank connected to the second set of print heads to draw the first ink or the second ink from the second set of print heads.

14. The printer system of claim 1, further comprising:

a degasser positioned between a primary ink tank and a corresponding secondary tank configured to provided degassed ink to the corresponding secondary tank.

15. The printer system of claim 1, wherein the printer system is applicable one or more ink color groups that comprise at least a black color group, a yellow color group, a cyan color group, or a magenta color group.

* * * * *